US005628479A

United States Patent [19]

Ballinger

[11] Patent Number: 5,628,479

[45] Date of Patent: May 13, 1997

[54] VITAL WHEEL DETECTOR

[75] Inventor: Forrest H. Ballinger, Grain Valley, Mo.

[73] Assignee: Harmon Industries, Inc., Blue Springs, Mo.

[21] Appl. No.: 571,065

[22] Filed: Dec. 12, 1995

[51] Int. Cl.[6] ..... B61L 1/00

[52] U.S. Cl. ..... 246/249; 246/122 R; 324/179; 340/941

[58] Field of Search ..... 246/122 R, 124, 246/122 A, 167 A, 246, 247, 249, 254, 255; 324/178, 179, 263, 200, 207.15, 207.16, 207.26; 340/941, 551

[56] References Cited

U.S. PATENT DOCUMENTS

| | | | |
|---|---|---|---|
| 4,200,856 | 4/1980 | Gilcher | 246/249 |
| 4,351,504 | 9/1982 | Frielinghaus | 246/249 |
| 4,469,298 | 9/1984 | Uebel | 246/249 |
| 5,129,606 | 7/1992 | Rodems et al. | 246/249 |
| 5,333,820 | 8/1994 | Gilcher | 246/249 |
| 5,395,078 | 3/1995 | Gellender | 246/249 |

*Primary Examiner*—Mark T. Le
*Attorney, Agent, or Firm*—Chase & Yakimo

[57] ABSTRACT

A vital wheel detector for railways injects an oscillating electrical current into a short rail segment and produces a monitor signal in response the magnetic field around the rail. A high Q pickup coil is employed which, when a car wheel is present on the rail segment, sharply decreases in Q and significantly reduces the level of the monitor signal. Any failure of the detector apparatus is in a safe mode, as a loss of rail current results in a loss of the monitor signal whether through an electrical or a mechanical failure. Also, internal mechanical or electrical failures either interrupt the current to the rail or interrupt transmission of the monitor signal to the processing logic.

10 Claims, 6 Drawing Sheets

VITAL WHEEL DETECTOR

BACKGROUND OF THE INVENTION

This invention relates to improvements in vital wheel detectors for railways and, in particular, to a detector apparatus which injects an oscillating electrical current into one rail of the track and does not rely on the sensing of a shunt current to detect the presence of a wheel in a detection zone.

Wheel detectors are employed as key components of various control systems used in railways, including grade crossing warning control systems, hotbox detectors, and control systems utilized in hump yards. A "vital" wheel detector, in contrast to non-vital, must unfailingly detect the presence or passing of a car wheel and fail in a safe mode, i.e., disclose a failure so that the control system in which it functions can produce an appropriate warning. To be truly vital, such a detector upon failure either fails to produce an output signal or responds in the same manner as if a wheel were present in the detection zone.

Vital requirements should not be limited to electrical failures of the detector circuitry or components. A mechanical or physical fault should also produce a failure indication. Typically, a wheel detector is secured to or mounted adjacent the track and thus a dismounted condition or separation of its parts should cause a loss of or change in the output of the detector indicative of its physical disability. Furthermore, it is desired that a vital detector not depend upon rail/wheel shunting to detect the approach or presence of a train because of the uncertainty, under rusty rail conditions, of relying upon the establishment of an electrical shunt across the rails by the wheels and axles of the train.

SUMMARY OF THE INVENTION

It is, therefore, the primary object of the present invention to provide a vital wheel detector which does not rely upon rail/wheel shunting and which accomplishes detection on a fail-safe basis by injecting an oscillating electrical current into one rail and sensing the presence of a wheel thereon.

In furtherance of the foregoing object, it is an important aim of this invention to provide such a detector in which the current is injected into the rail and caused to flow in a short segment of the rail and produce a field, and wherein changes in the field are sensed by the detector to determine whether a wheel of a train is present on the rail segment.

Another important object of the invention is to provide such a detector in which the current is injected into the rail by a pair of relatively closely spaced, electrically conductive members that are secured to the rail in longitudinally spaced relationship thereto and in electrical contact therewith, thereby defining therebetween the short segment of the rail through which the current flows.

Still another important object is to provide a detector as aforesaid in which the conductive members also serve as a mount for a detecting means that produces a monitor signal in response to the field of the current flowing in the rail segment, whereby a loss of current flow in the segment renders the detecting means incapable of producing the monitor signal.

Still another important object is to provide a wheel detector as set forth in the preceding objects in which securement of the members to the rail and integrity of the functioning units of the apparatus are required in order for the monitor signal to be produced, the loss of which indicates that the wheel detector has failed.

Yet another important object is to provide such a wheel detector apparatus having a driver unit fastened to the current-injecting members, and a detector unit attached to the driver unit and connected to a signal processing means for determining from the monitor signal whether a wheel of a train is present on the rail segment, wherein the arrangement is such that detachment of the detector and driver units from each other or from the members results in a loss of the monitor signal.

Furthermore, it is an important object of this invention to provide a detecting means positioned in the magnetic field around the current-carrying rail segment, and which employs a high Q pickup coil responsive to the field and having a ferrite core, the coil decreasing in Q when a wheel is present on the segment to cause the monitor signal to shift in level.

Other objects will become apparent as the detailed description proceeds.

THE DETECTOR APPARATUS

Figure 1:
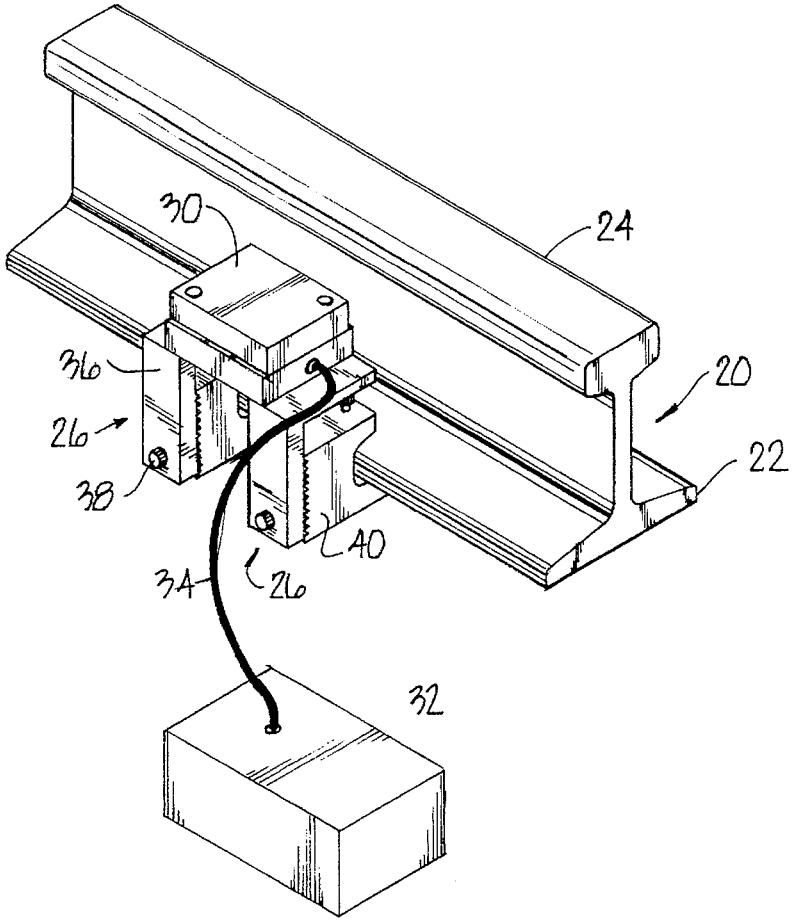
FIG. 1 is a perspective view showing a portion of a rail and the wheel detector apparatus of the present invention secured thereto.
Figure 2:
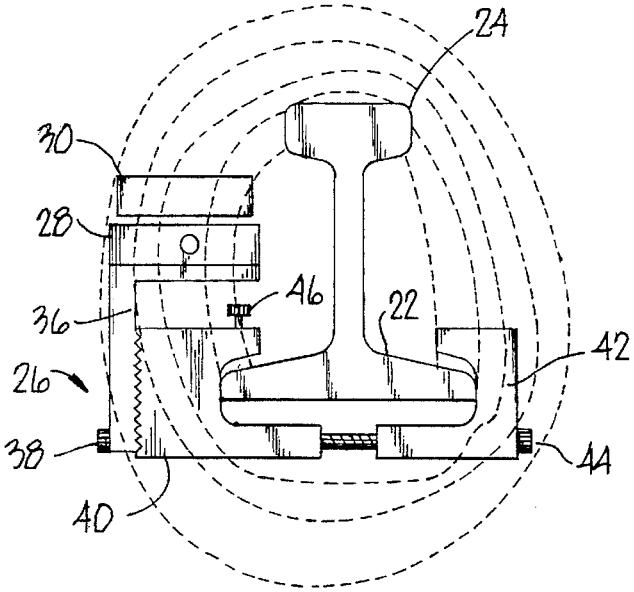
FIG. 2 shows the rail section of FIG. 1 in profile (vertical cross-section), and illustrates the magnetic field produced and the physical relationship of the functional units of the detector apparatus.
Figure 3:
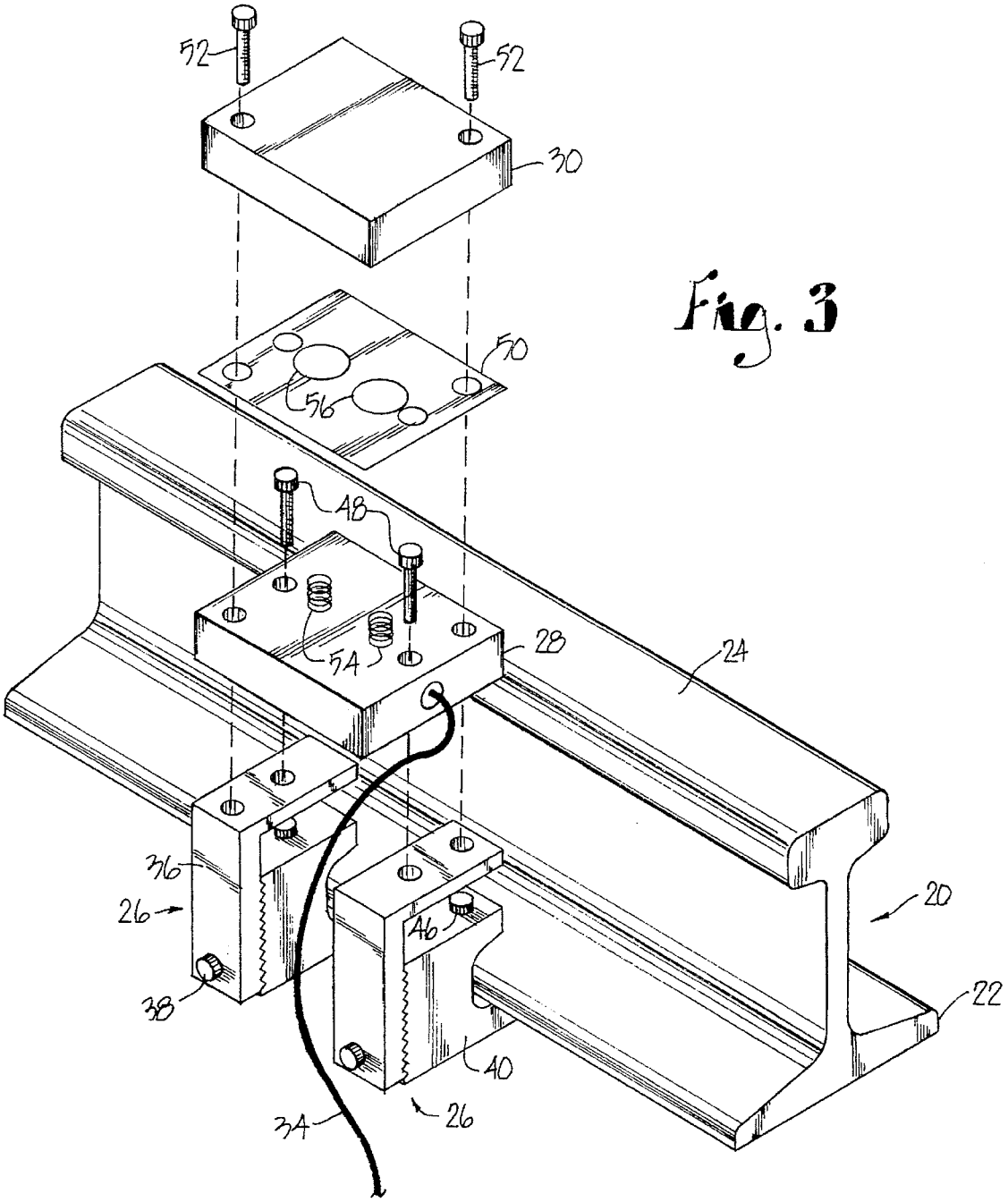
FIG. 3 is an enlarged, exploded view similar to FIG. 1.

Referring initially to FIGS. 1–3, one of the rails 20 of a railroad track is shown fragmentarily and has the usual foot or base 22 and a ball 24 on which the wheels of a train run, as will be discussed. The vital wheel detector apparatus of the present invention is shown secured to the foot 22 of rail 20 and includes a pair of metal mounting brackets 26 spaced longitudinally of rail 20, a driver unit 28 and a detector unit 30 mounted on the brackets 26, and a signal processing unit 32 (FIG. 1) connected to the driver unit 28 by a suitable cable 34. Each of the brackets 26 is electrically conductive and includes a vertically adjustable angle 36 which presents a horizontal shelf upon which the driver unit 28 is secured. Release of a screw 38 permits the angle 36 to be moved upwardly or downwardly to the desired height, and then tightened in place by screw 38 and held by the complemental serrations on the abutting faces of the vertical leg of the angle 36 and the body portion 40 of bracket 26.

It may be seen in FIG. 2 that each of the mounting brackets 26 includes a standard rail clamp having jaws presented by body portion 40 and a distal jaw piece 42 that engages the outside edge of foot 22. The rail clamps are tightened in place by draw screws 44 when the apparatus is installed on the rail 20. Although the brackets 26 are electrically conductive, a good electrical connection of each bracket 26 with rail 20 is assured by a sharpened screw 46 threaded through body portion 40 and engaging the upper surface of foot 22.

The electrically conductive members presented by the two brackets 26 are spaced from each other a distance of about six to eight inches (15 to 20 centimeters) and define a short segment of the rail 20 therebetween which, as will be appreciated, is the detection zone of the apparatus. Each of the units 28 and 30 is encapsulated in an epoxy resin or the like and has a flat, rectangular configuration as may be best seen in the exploded view of FIG. 3. The lower, driver unit 28 is mounted directly on brackets 26 by a pair of screws 48 which also provide the exclusive electrical connection of the driver unit 28 to the conductive metal material of brackets 26. A gasket 50 overlies driver unit 28, and detector unit 30 is secured thereover by a pair of bolts 52 which extend through gasket 50, unit 28, and the mounting shelf presented by the horizontal arms of angles 36. A pair of conductive springs 54 extend through clearance openings 56 in gasket 50 and provide a normally closed electrical connection from detector unit 30 to cable 34 through the driver unit 28. The arrangement of units 28 and 30, fasteners 48 and springs 54 are part of the fail-safe design of the detector apparatus of the present invention, as will be appreciated from the following description of the electrical details of the system.

Figure 6:
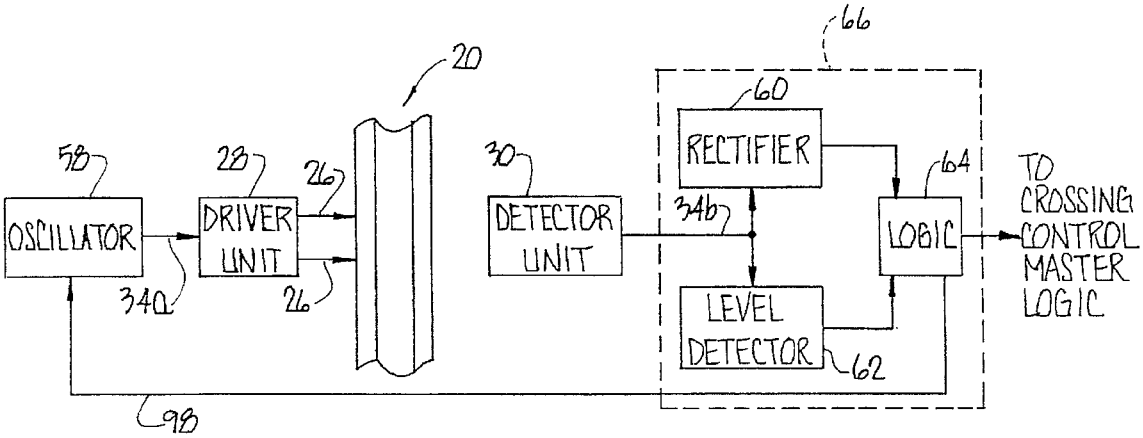
FIG. 6 is an electrical block diagram of the wheel detector apparatus.

The block diagram of FIG. 6 shows the general electrical interrelationship of the components of the apparatus described above. In addition, an oscillator 58 is connected to the input of driver unit 28 as indicated at 34*a*, the latter comprising a pair of leads of cable 34. The detector unit 30 has an output connected by a lead pair 34*b* to a rectifier 60 and a level detector 62. Output signals from both the rectifier 60 and the level detector 62 are delivered to processing logic 64, it being understood that the rectifier 60, level detector 62 and logic 64 are all components of a processor 66 located in the signal processing unit 32 seen in FIG. 1. In the illustrated embodiment the oscillator 58 is also located in the signal processing unit 32 as shown in FIG. 7, connections to the driver unit 28 being made via the cable 34 that includes lead pairs 34*a* and 34*b*.

Figure 7:
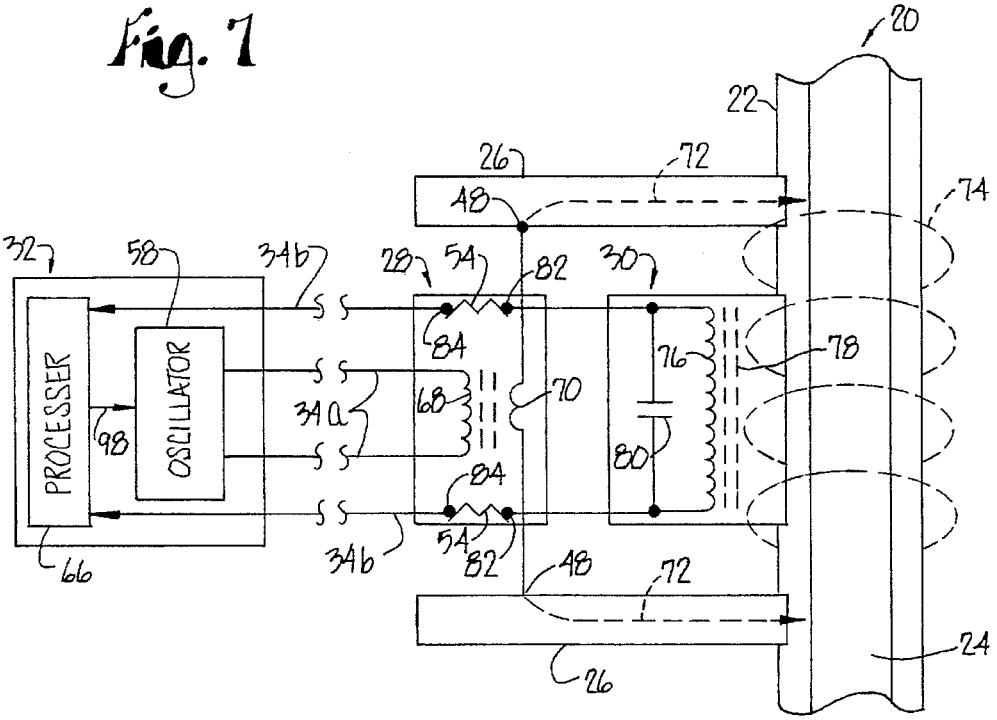
FIG. 7 is a schematic diagram showing, in particular, the driver and detector units.

Referring to FIG. 7, the driver unit 28 has a matching transformer for coupling the output of oscillator 58 with the rail 20, and includes a primary 68 connected to leads 34*a* and a secondary winding 70 connected to the two brackets 26 by respective screws 48 as schematically illustrated. The current path to the rail 20 is illustrated by the two broken lines 72, such paths 72 being provided by the conductive brackets 26 that are secured to the foot 22 of rail 20. The current thus injected into the rail 20 (for example, 20 to 50 ma.) flows in the short rail segment between the spaced brackets 26 and produces a magnetic field about the rail segment as illustrated at 74.

The detector unit 30 contains a pickup coil 76 wound on a ferrite coil 78 and positioned in the field 74 (see also FIG. 9) so as to be responsive thereto. A capacitor 80 is connected across coil 76 to provide a parallel resonant circuit tuned to the frequency of the current injected into the rail. The frequency of oscillator 58 may be in the range of from approximately 50 to 300 kHz, a frequency of 130 to 250 kHz being preferred. A feedback connection 98 from logic 64 to oscillator 58 (see FIG. 6) is provided for the purpose of adjusting the oscillator frequency to compensate for drift in the resonant frequency of the coil 76 and capacitor 80 due to changes in temperature at the track site.

FIG. 7 also schematically illustrates the conductive springs 54 that provide the normally closed electrical connection from the respective ends of pickup coil 76 to the lead pair 34*b* through the driver unit 28. An upper contact 82 for each spring 84 is physically located in the bottom of unit 30, and a lower contact 84 for each spring 54 is located in the top of driver unit 28 and is vertically aligned with the corresponding contact 82 when units 28 and 30 are secured together by bolts 52. Therefore, as long as each spring 54 is compressed and sandwiched between its associated contacts 82 and 84, there is electrical continuity from the detector unit 30 to the processor 66 in the signal processing unit 32. However, if the detector and driver units 30 and 28 become detached from each other or partially dismounted due to release of one or both of the bolts 52, separation of one or both of the contact pairs 82–84 will occur and the springs 54 will be released, thereby interrupting continuity to the processor 66.

Figure 4:
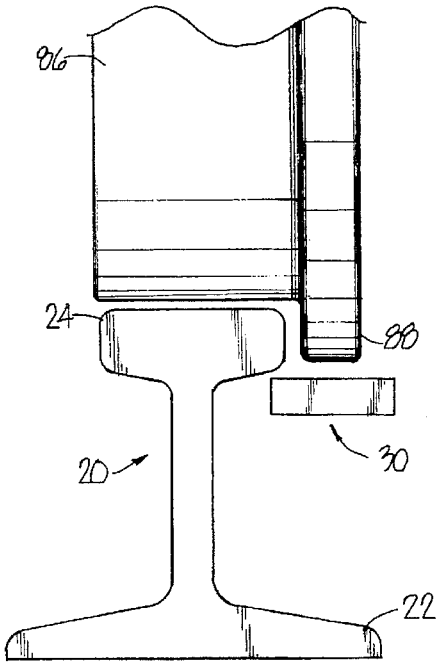
FIG. 4 is a diagrammatic illustration showing the profile of a rail, a wheel (fragment) on the rail, and the position of the pickup coil of the present invention.
Figure 5:
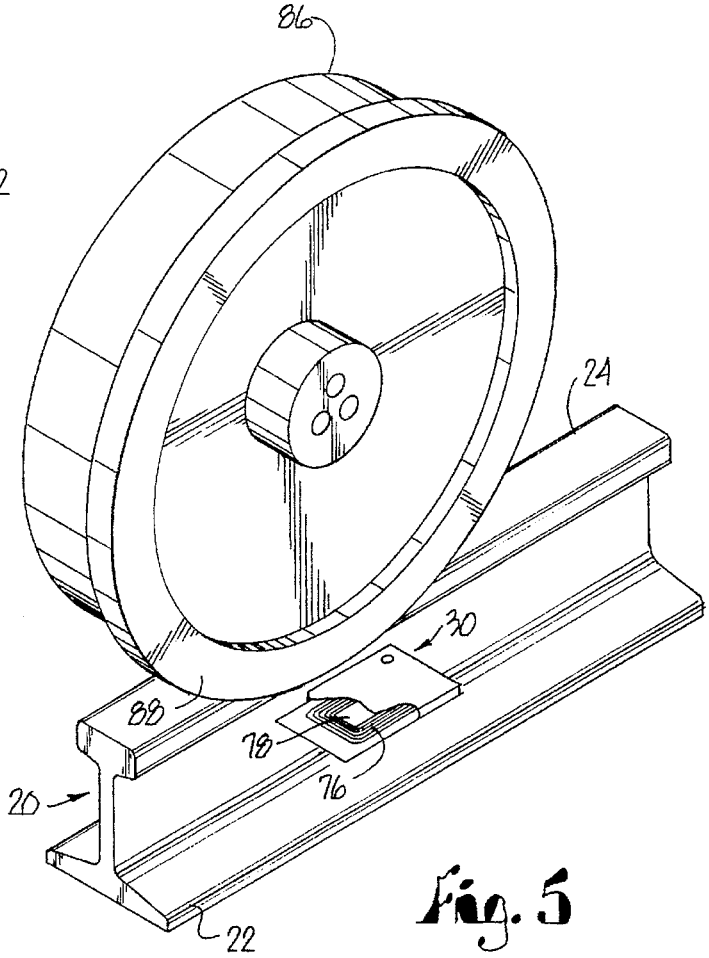
FIG. 5 is a diagrammatic, perspective view illustrating the relative positions of the rail, wheel and pickup coil.

Referring particularly to FIGS. 4 and 5, the detector unit 30 of the apparatus is shown alone in relation to a passing car wheel 86 having a typical wheel flange 88 that runs adjacent the inside edge of the ball 24. The encapsulation of unit 30 is broken away in FIG. 5 to reveal the flat, horizontally extending configuration of the coil 76 and its core 78. With respect to the orientation of the coil 76 in its operative position shown (directly beneath wheel flange 88), the turns of coil 76 are wound in a horizontal plane about core 78 and thus provide coil 76 with a vertical axis that is either aligned with flange 88 as in FIG. 4 or very closely spaced therefrom. Close vertical spacing is maintained by adjustment of the shelf angles 36 at the time of installation.

The pickup coil 76 has a very high "Q" (quality factor) due to its windings and the presence of the ferrite core 78. For example, coil 76 may be wound on a rectangular flat bobbin formed by gluing two 5-inch×3-inch nonconductive plates to the opposite faces of a 3-inch×1.1-inch ferrite slab (core 78) having a thickness of about 0.2 inches. The winding may comprise 37 turns of 105 strand, No. 36 Litz wire. In a coil of such a design, a 3-dB Q of greater than 100 may be obtained and will assure a very significant response to the presence on rail 20 of the ferrous material of wheel flange 88.

OPERATION

The apparatus is clamped to the rail foot 22 at the detection site and power is supplied to the processing unit 32 from a trackside source (not shown). The output of logic 64 is connected to the control system, such as a grade crossing warning control system as illustrated in FIG. 6. The function of the detector apparatus in such an application is, of course, to detect the presence of a passing wheel 86 or a car wheel that is stationary and centered on the rail segment extending between the two brackets 26.

Figure 9:
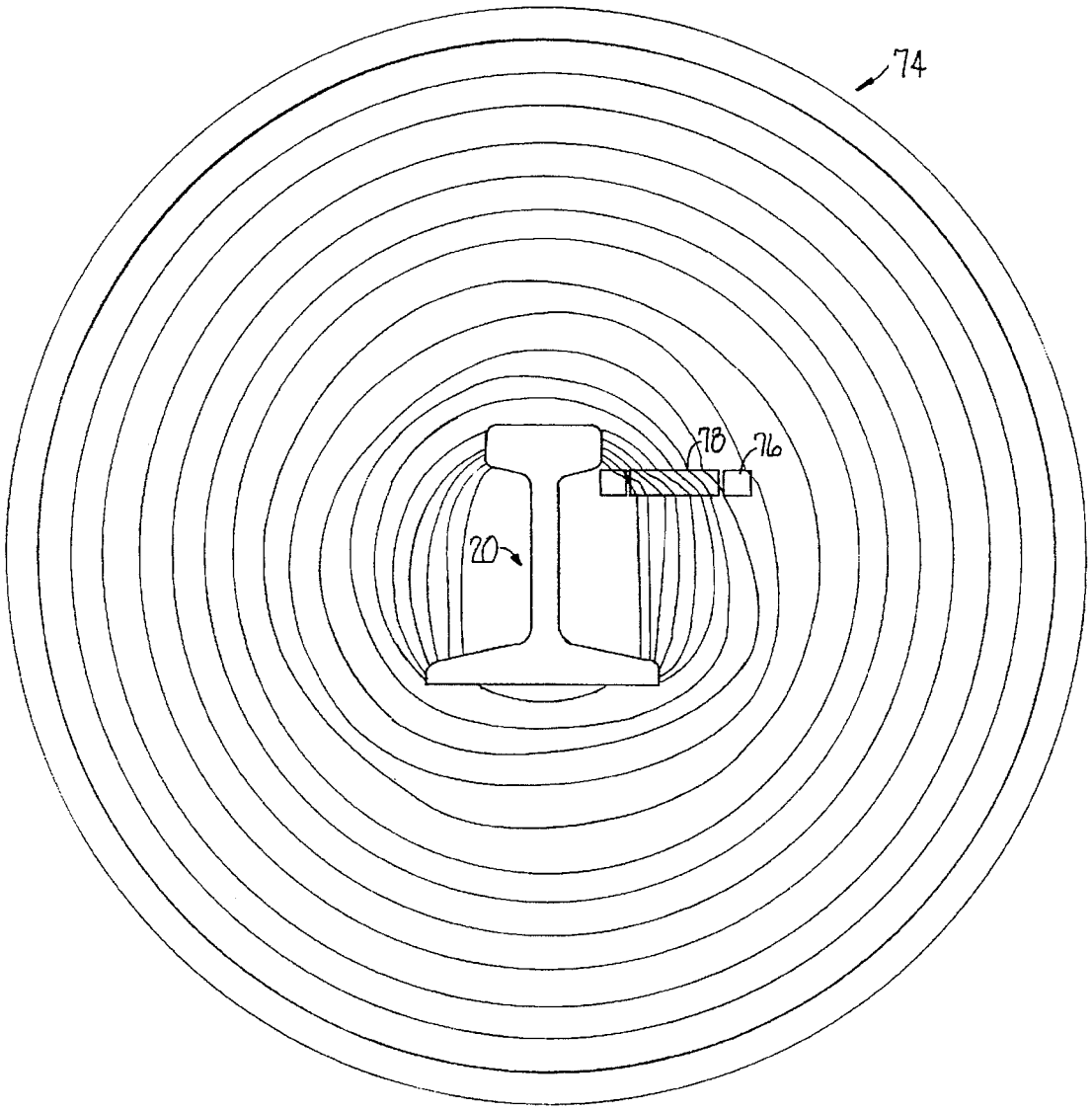
FIG. 9 is a computer generated flux analysis showing the current-carrying rail segment in profile.

A preferred frequency for oscillator 58 is 132 kHz, the oscillating current being injected into the rail segment by the brackets 26. The oscillating magnetic field 74 thus created is illustrated in FIG. 9 where it may be seen that the lines of flux adjacent the rail 20 are directed through the pickup coil 76 and, in particular, are concentrated in the ferrite core 78. During the presence or passage of wheel 86, inductive coupling between the coil 76 and the wheel flange 88 causes eddy currents to be induced into the flange and sharply decreases the Q of the coil 76.

Figure 8:
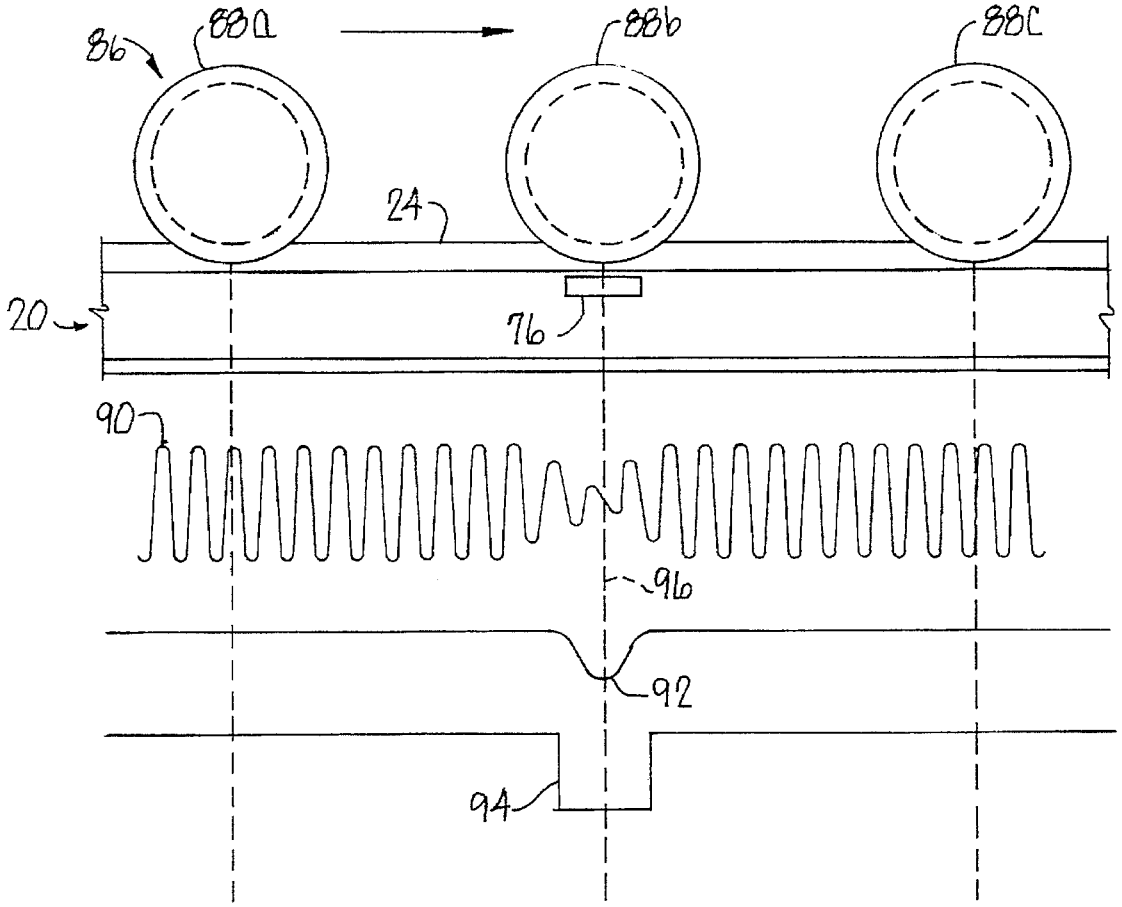
FIG. 8 is a graph illustrating the response of the apparatus to a passing wheel.

The effect of the change in Q is illustrated in the timing diagram of FIG. 8. Wheel 86 is depicted moving from left to right along rail 20; three successive positions are illustrated by wheel flange 88*a*, 88*b* and 88*c*. At the center position (88*b*) the wheel is directly over pickup coil 76. The time related graphs below rail 20 in FIG. 8 show the outputs of the coil 76, rectifier 60 and level detector 62. The output of coil 76 provides an oscillating monitor signal 90 of constant amplitude until affected by the wheel flange 88*b*, at which time the sharp decrease in the Q of the coil reduces the signal level by as much as 75%. Likewise, the rectifier output is steady until the wheel is detected, and then dips to a minimum at 92 at the instant that the wheel flange 88*b* is centered over the coil 76 (timing line 96). The level detector 62 produces a square wave or notch 94 in response to the abrupt reduction, and ensuing return, of the monitor signal level. The presence of the wheel flange 88*b* also shifts the resonant frequency of coil 76 and capacitor 80 by a small percentage, but this is a secondary effect which only enhances the reduction in the output signal level of detector coil 76 caused by the loss of Q.

The processing logic 64 (FIG. 6) receives the output of both the rectifier 60 and the level detector 62 and thus, depending upon the application, may be responsive to both the dip 92 in the rectifier output and the notch 94 in the level detector output. The minimum level or nose of the dip 92 in the rectifier output occurs at timing line 96 and thus may be used by the processing logic in applications where the precise time of occurrence of the nose must be ascertained, such as when two detectors of the present invention are spaced along a track a preset distance and used as inputs to determine the exact speed of a passing train.

From the foregoing, it should be appreciated that the detector apparatus of the present invention satisfies vital requirements. If either bracket 26 (FIG. 3) is not secured to the rail 20, no current will flow in the segment between the brackets 26 and thus there will be a complete loss of the monitor signal 90. The monitor signal is also lost if the detector unit 30 is dislodged from its intended rail position, either through failure to properly secure the brackets 26 or the release of bolts 52. Furthermore, any other failure of the output signal from oscillator 58 to be injected into the rail segment, either of an electrical or a mechanical nature, will cause the apparatus to fail in a safe mode. If the driver unit 28 is not properly secured to both brackets 26 by the screws 48, there is no current path to the rail segment. In the event that units 28 and 30 become separated or misaligned, current may still flow in the rail segment but the release of one or both of the springs 54 interrupts the monitor signal to the processing logic 66. Therefore, any failure of the detector apparatus will be identified as such due to the loss of the monitor signal 90.

Having thus described the invention, what is claimed as new and desired to be secured by Letters Patent is as follows:

1. A vital wheel detector apparatus for railways comprising:

a longitudinally extending rail, a pair of relatively closely spaced, electrically conductive mounting members, means securing said members to said rail in longitudinally spaced relationship thereto and in electrical contact therewith, whereby a short segment of the rail extends between the two members, driver means for delivering an oscillating electrical current to said members for injection into the rail, whereby to cause the current to flow in said segment between said members, and detector means mounted on said members in an operative position proximate to said segment for producing a monitor signal in response to a field produced by the current flowing in said segment, and further responsive to changes in said field resulting from the presence of a wheel of a train on said segment for modifying said monitor signal in a manner indicative of the presence of said wheel, whereby a loss of current flow in said segment renders the apparatus incapable of producing the monitor signal and responding to the presence of a wheel on said segment.

2. The apparatus as claimed in claim 1, wherein said detector means includes a high Q pickup coil responsive to said field and having a ferrite core, said coil decreasing in Q when a wheel is present on said segment to cause said monitor signal to shift in level.

3. The apparatus as claimed in claim 2, wherein the frequency of said electrical current is in the range of approximately 50 to 300 kHz.

4. The apparatus as claimed in claim 2, wherein said driver means includes an oscillator having a predetermined frequency of operation, and wherein said detector means further includes a capacitor connected with said coil for presenting a circuit tuned to said predetermined frequency.

5. The apparatus as claimed in claim 1, wherein said detector means includes a high Q pickup coil responsive to said field, positioned to be beneath the flange of a wheel present on said segment, and having an upright axis and a flat, horizontally extending configuration, said coil being provided with a ferrite core, whereby the presence of a wheel on said segment decreases the Q of the coil to thereby effect said modification of the monitor signal.

6. The apparatus as claimed in claim 1, wherein said rail has a foot, and wherein said members comprise mounting brackets secured to said foot by said securing means and extending laterally therefrom.

7. The apparatus as claimed in claim 1, wherein said rail has a foot, and wherein said securing means includes a pair of clamps engaging said foot to define said segment therebetween and secure the respective members thereto.

8. The apparatus as claimed in claim 1, wherein said driver means includes a driver unit for applying said current to said members, and wherein said apparatus further comprises fastener means mounting said driver unit on said members and providing the exclusive electrical interconnection of said driver unit and said members, whereby release of said fastener means breaks said interconnection and prevents said current flow in said segment.

9. The apparatus as claimed in claim 1, further comprising output means connecting said detector means to a signal processing means which determines from said monitor signal whether a wheel of a train is present on said segment, said output means including a normally closed connection which, if the detector means should become dismounted from said members, assumes an open condition interrupting continuity to said signal processing means, whereby securement of the members to the rail and integrity of the apparatus are required in order for the monitor signal to be produced by the detector means and received by the signal processing means.

10. A vital wheel detector apparatus for railways comprising:

a longitudinally extending rail, a pair of relatively closely spaced, electrically conductive mounting members, means securing said members to said rail in longitudinally spaced relationship thereto and in electrical contact therewith, whereby a short segment of the rail extends between the two members, a driver unit for delivering an oscillating electrical current to said members for injection into the rail, whereby to cause the current to flow in said segment between said members, fastener means mounting said driver unit on said members and providing the exclusive electrical interconnection of said driver unit and said members, whereby release of said fastener means breaks said interconnection and prevents said current flow, a detector unit attached to said driver unit and mounted in an operative position proximate to said segment for producing a monitor signal in response to a field produced by said current flowing in said segment, and further responsive to changes in said field resulting from the presence of a wheel of a train on said segment for modifying said monitor signal in a manner indicative of the presence of said wheel, output means connecting said detector unit to a signal processing means which determines from said monitor signal whether a wheel of a train is present on said segment, and said output means including a normally closed connection through said driver unit which, if the detector and driver units should become detached from each other, assumes an open condition interrupting continuity to said signal processing means, whereby securement of the members to the rail and integrity of the apparatus are required in order for the monitor signal to be produced by the detector unit and received by the signal processing means.

* * * * *